United States Patent [19]

Ohuchi

[11] Patent Number: 5,035,215

[45] Date of Patent: Jul. 30, 1991

[54] ENGINE REVOLUTION CONTROL APPARATUS FOR VEHICLE

[75] Inventor: Hirofumi Ohuchi, Himeji, Japan

[73] Assignee: Mitsubishi Denki K.K., Tokyo, Japan

[21] Appl. No.: 551,347

[22] Filed: Jul. 12, 1990

[30] Foreign Application Priority Data

Jul. 13, 1989 [JP] Japan ..... 1-180959
Jul. 13, 1989 [JP] Japan ..... 1-180961

[51] Int. Cl.[5] ..... F02D 41/16
[52] U.S. Cl. ..... 123/339
[58] Field of Search ..... 123/339

[56] References Cited

U.S. PATENT DOCUMENTS 4,549,512 10/1985 Takao et al. ..... 123/339
4,825,829 5/1989 Abe ..... 123/587 X

FOREIGN PATENT DOCUMENTS 62-43055 9/1987 Japan .

*Primary Examiner*—Tony M. Argenbright
*Attorney, Agent, or Firm*—Sughrue, Mion, Zinn, Macpeak & Seas

[57] ABSTRACT

An engine revolution control apparatus for a vehicle, in which revolutions of an engine when the engine is in the idling state, e.g., when the vehicle is being stopped and a throttle valve is totally closed, is controlled by controlling the opening of an air control valve which is provided in a by-pass conduit for by-passing the throttle valve according to a revolution feedback correction volume. The revolution feedback correction volume is calculated according to the deviation between the actual revolutions of the engine and its target revolutions which was set according to the load of the engine, increasing, in the non-idling state of the engine, the revolution feedback correction volume, which is calculated when the engine has shifted from the idling state to the non-idling state as well as when the deviation between the actual revolutions and the target revolutions is small. Thus, when the engine is shifted to the idling state again, the engine is not affected by an undetected current consumer such as an ON signal of a headlight which was injected when the engine was in the non-idling state. As a result the actual revolutions can smoothly be converged with the target revolutions with better responsiveness.

8 Claims, 6 Drawing Sheets

2
9
3
5
11
8
7
10
6
20
17
4
14
ELECTRONIC
AIR VOLUME
CONTROL UNIT
1
22
21
12
15
18
16
13
19

ENGINE REVOLUTION CONTROL APPARATUS FOR VEHICLE

BACKGROUND OF THE INVENTION

1. Field of the Invention

The present invention relates to an engine revolution control apparatus for a vehicle, and more particularly it relates to control of revolutions of an engine when the engine is in the idling state.

2. Description of Related Art

With a conventional engine revolution control apparatus for a vehicle, when an engine is in the idling state, the apparatus sets target revolutions of the engine corresponding to the load of the engine, and then controls an air control valve being provided in a by-pass conduit for by-passing a throttle valve so that actual revolutions of the engine can be converged onto this target number of revolutions. The conventional engine revolution control apparatus for a vehicle controls revolutions of the engine according to both the basic air volume to be set corresponding to the load of the engine and the revolution feedback correction volume to eliminate the deviation between the actual revolutions and the target revolutions. Both of the basic air volume and the target revolutions are calculated according to such factors as deciding the state of operation of the engine.

In addition, the apparatus learns the revolution feedback correction volume so that the actual revolutions can be coincident with the target revolutions. When the state of the engine is shifted from the idling state to the non-idling state and then returned to the idling state, the revolution feedback correction volume which was learned in the former idling state is to be used to learn the revolution feedback correction volume in the latter idling state.

Incidentally, the engine revolution control apparatus for a vehicle controls the air supply volume to the engine by controlling the opening of the air control valve as described above, and the fuel supply volume to engine is decided by this air supply volume to the engine, and then, revolutions of the engine in the idling state is to be controlled.

In the above conventional engine revolution control apparatus for a vehicle, when a component which consumes current and thus affects the engine load, but which does not fetch a detection signal, such as an ON signal of a headlight, is actuated while the engine is in a non-idling state and as soon as the engine is directly returned to idling state, the revolution feedback correction volume which was determined in the idling state not having such a component activated is used to determine the adjustment rate of the air supply volume. In other words, the above case can be seen, for example, when the vehicle stops at a crossing, the engine revolution control apparatus for the vehicle determines the revolution feedback correction volume. Thereafter, when the vehicle is traveling, a current consumer, such as the headlight or a heater, is turned on, and then when the vehicle stops again at another crossing, the revolution feedback correction volume which was determined before is to be used. However, when the engine begins idling again, the air supply volume correponding to the current consumer will be inadequate. Accordingly, the actual revolutions of the engine will temporarily become less than the target revolutions as soon as the engine begins idling, and the engine may stall.

The reduction of the actual revolutions can be corrected and avoided when the next revolution feedback correction volume is determined. However, the next revolution feedback correction volume may not occur for awhile so that the vehicle driver will be discomforted as he or she drives the vehicle.

SUMMARY OF THE INVENTION

The foregoing problems are solved in accordance with the present invention. The primary object of the present invention is to provide an engine revolution control apparatus for a vehicle, which decides whether an engine is in the idling state, and then decides in the non-idling state of the engine whether the state of the engine has shifted from the idling state to the non-idling state. When it is decided that the state of the engine has shifted to the non-idling state, the revolution feedback correction volume is increased. Accordingly, even where the load of engine, such as a current consumer, is increased in the engine of the non-idling state and then the engine becomes idle again, the air supply volume corresponding to the increased load is compensated for. Then, the actual revolutions of the engine can smoothly be converged with the target revolutions of the engine.

Another object of the present invention is to provide an engine revolution control apparatus for a vehicle, in which the revolution feedback correction volume is increased when it is decided in the non-idling state that the engine has shifted from the idling state to the non-idling state as well as when the actual revolutions is close to the target revolutions in the idling state. Then, even where the state of the engine is repeatedly shifted from the idling state to the non-idling state in a short time, the increased revolution feedback correction volume is not liable to be further increased and the actual revolutions can smoothly be converged with the target revolutions.

The above and further objects and features of the invention will more fully be apparent from the following detailed description with the accompanying drawings.

DESCRIPTION OF THE PREFERRED EMBODIMENTS

Now will be described below one embodiment of the present invention with reference to the accompanying drawings.

Figure 1:
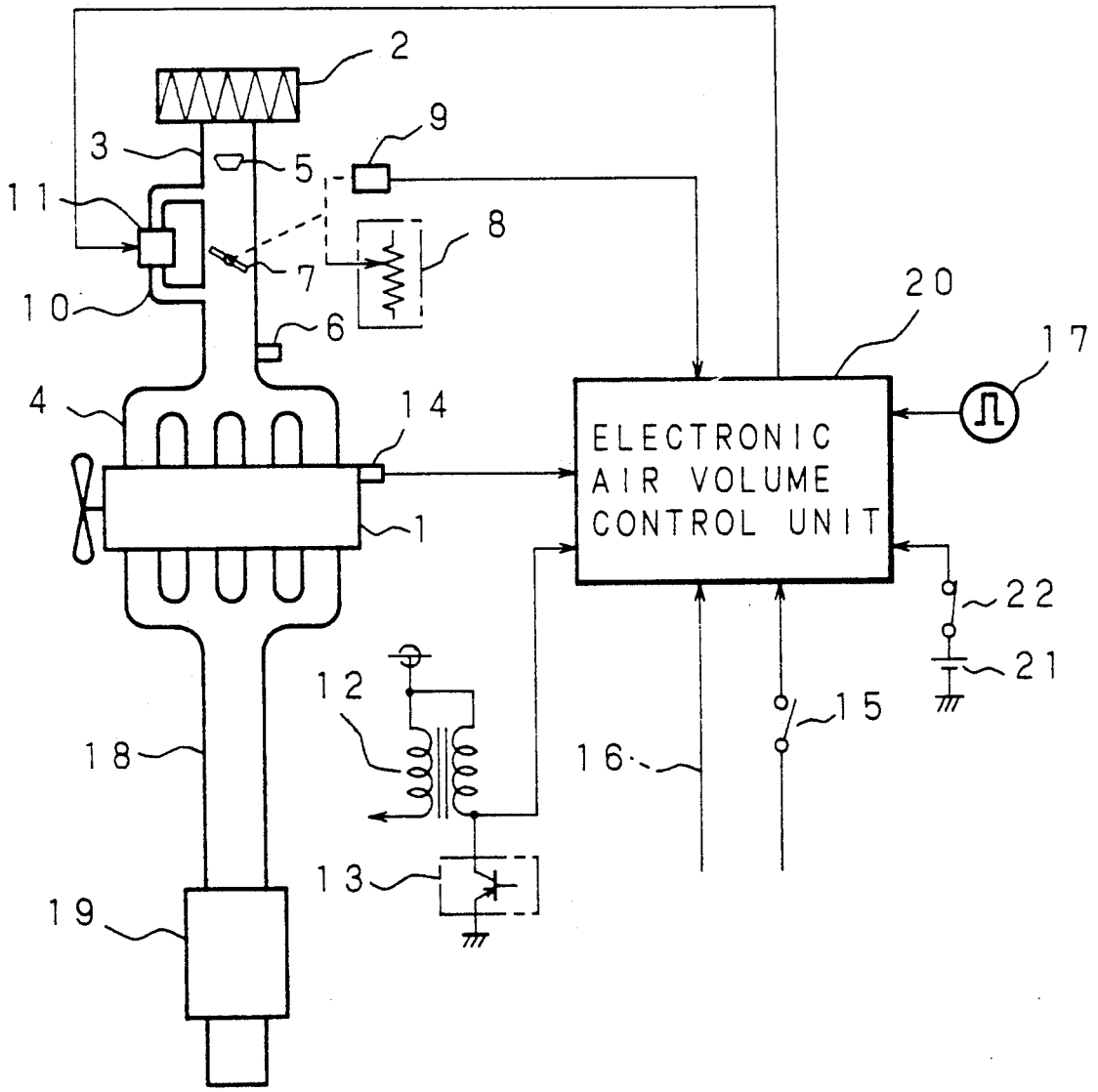
FIG. 1 is a schematic view to illustrate construction of an engine revolution control apparatus for a vehicle in accordance with the present invention.

In FIG. 1, is shown an engine 1, which is loaded in a vehicle or the like, and which inhales air through an air cleaner 2, an air intake pipe 3, and an air intake manifold 4. Fuel is injected and supplied into the engine 1 from an electro-magnetic fuel injection valve 5 of simple substance which is provided in the air intake pipe 3. The volume of the fuel which is injected into the engine 1 is decided by a fuel control system (not shown) in response to an output signal of a pressure sensor 6 which detects the pressure in the air intake pipe 3 by the absolute pressure, for example. At the downstream side of the electro-magnetic fuel injection valve 5 which is provided in the air intake pipe 3, there is provided a throttle valve 7 which adjusts the substantial air inhalation volume of the engine 1 by a drivers' arbitrary operation of an accelerator pedal (not shown). Opening of throttle valve 7 is detected by a throttle opening sensor 8, and totally closing the throttle valve 7 is detected by an idle switch 9.

Reference numeral 10 designates a by-pass conduit for by-passing the throttle valve 7 provided at the downstream side of the electro-magnetic fuel injection valve 5. In this by-pass conduit 10, there is provided an air control valve 11 to control the air volume in the by-pass conduit 10. One end of this by-pass conduit 10 is connected to an air inlet which is provided in between the electro-magnetic fuel injection valve 5 and the throttle valve 7. The other end of the by-pass conduit 10 is connected to an air outlet which is provided at a portion downstream of the throttle valve 7.

As for the air control valve 11, there is employed an electro-magnetic control valve which will open according to a duty ratio of a driving signal which is input thereto, for example, so that the flow passage cross-sectional area of the by-pass conduit 10 can be controlled in proportion to the duty ratio.

An ignition device of the engine 1 is connected to an ignition control system which outputs an ignition signal according to the driving condition parameter of the engine 1, and which comprises an igniter 13 which on-off controls the primary current of an ignition coil 12 in response to the ignition signal, the ignition coil 12, a distributor (not shown), an ignition plug (not shown), and the like.

Reference numeral 14 designates a cooling water temperature sensor which detects the temperature of cooling water to determine the temperature of the engine 1, reference numeral 15 designates a current consumer switch which injects a load current of auxiliary equipment as an air conditioner, reference numeral 16 designates a signal conductor which transmits a tor-con signal of an automatic transmission, and reference numeral 17 designates a vehicle speed sensor which outputs a pulse signal of the frequency which is in proportion to the rotating speed of an axle to detect the vehicle speed. The above-described elements are connected to an electronic air volume control unit 20 which will be referred to later. Reference numeral 18 designates an exhaust pipe of the engine 1 and reference numeral 19 designates a catalyzer. After the air-fuel mixture which was combusted by the engine 1 becomes exhaust gas, it goes through the exhaust pipe 18 via the catalyzer 19 to be purified and exhausted to the outside.

Reference numeral 20 designates the electronic air volume control unit, which is the engine revolution control apparatus for a vehicle in accordance with the present invention, and which is powered by a battery 21 via key switch 22. In response to output signals from the idle switch 9 and the vehicle speed sensor 17, the electronic air volume control unit 20 decides whether the engine is idling. According to this decision, it calculates the control volume of the air control valve 11 in response to an ignition signal of the primary side of the ignition coil 12, an output signal from the cooling water temperature sensor 14, and output signals from the current consumer switch 15 and the signal conductor 16. Thereafter, unit 20 controls driving of the air control valve 11 so as to control revolutions of the engine 1 in the idling state.

Hereinafter, the electronic air volume control unit 20 will be described with reference to FIG. 2.

The electronic air volume control unit 20 consists of a microcomputer 100, first through third input interface circuits 101, 102, 103, an output interface circuit 104, and a power supply circuit 105. The microcomputer 100 consists of a CPU 200 which calculates the control volume of idle revolutions of the engine 1 according to a predetermined program, a counter 201 which measures the revolving cycle of the engine 1, a plurality of timers 202 which measure a predetermined period of time at every 100 ms and the duty ratio of the driving signal, an A/D converter 203 which converts an analogue input signal into a digital signal, an input port 204 which inputs the digital signal, a RAM 205 which works as a work memory, a ROM 206 which stores programs for control operations, an output port 207 which outputs the driving signal, and a common bus 208 for inputting/outputting signals to/from the CPU 200. The waveform of the ignition signal at the primary side of the ignition coil 12 is shaped into an interruption signal in the first input interface circuit 101 and is inputted to the microcomputer 100. When this interruption signal is generated, the CPU 200 reads the value of the counter 201 and calculates the revolving cycle of the engine 1 according to the difference between this value and its former value and then stores this difference in the RAM 205. Noise in the output signal of the cooling water temperature sensor 14 is removed in the second input interface circuit 102, and this signal is outputted to the A/D converter 203. In the third input interface circuit 103, an ON signal of the current consumer switch 15, a neutral safety signal from the signal conductor 16, and a pulse signal of the vehicle speed sensor 17 are set to be each predetermined level and are outputted to the input port 204. In the output interface circuit 104, the driving signal from the output port 207 amplified and the like and outputted to the air control valve 11. The power supply circuit 105 allows the voltage of the battery 21 to be a constant voltage and supplies this constant voltage to the microcomputer 100.

Figure 3:
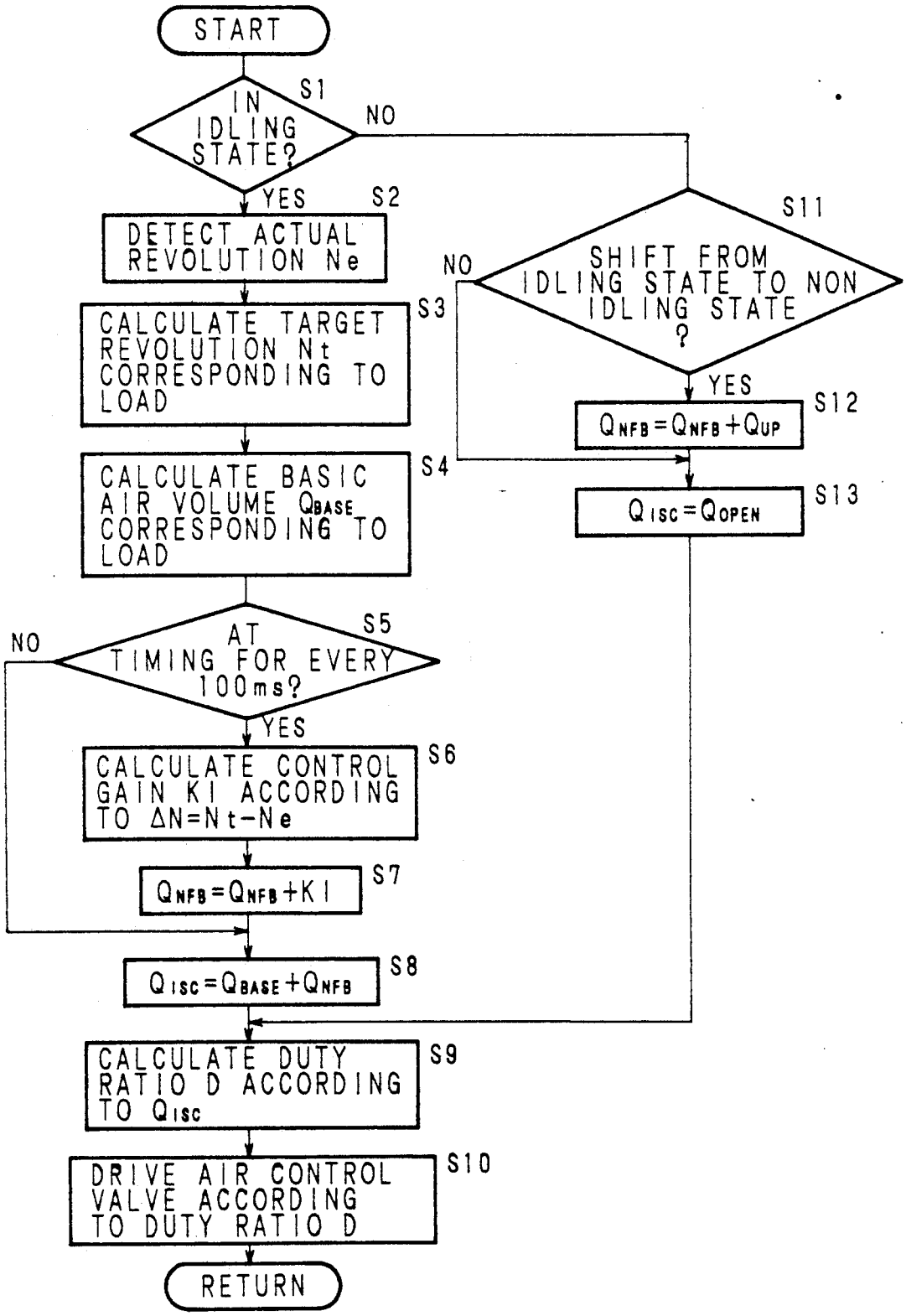

Hereinafter, operation of the microcomputer 100 will be described with reference mainly to FIG. 3.

In Step S1, it is decided whether the idle switch 9 is ON as well whether the vehicle speed sensor 17 is not generating a pulse signal, which means the vehicle is being stopped e.g., whether, the engine is in the idling state. If the engine is in the idling state, the operation proceeds to Step S2, in which the actual revolutions $N_e$ of the engine 1 is calculated according to the revolving cycle of the engine 1 which was calculated previously according to an interruption routine (not shown). Then, in Step S3, the target revolutions $N_t$ corresponding to the load of the engine 1 is calculated. More specifically, the target revolutions $N_t$ is calculated according to the cooling water temperature data WT outputted from the cooling water temperature sensor 14, according to whether the tor-con signal inputted from the signal conductor 16 is within either a neutral range or a drive range and as the output signal of the current consumer switch 15 is either an ON signal or an OFF signal, and the like, for example. In Step S4, as in the same way as Step S3, according to the cooling water temperature data WT, the tor-con signal, the current consumer signal, and the like, the basic air volume $Q_{BASE}$ corresponding to the load of the engine 1 is calculated. In Step S5, it is decided whether there is a timing at every predetermined period of time (100 ms for example) or not, and if not, the operation proceeds to Step S8. If there is a timing, the operation proceeds to Step S6.

Figure 4:
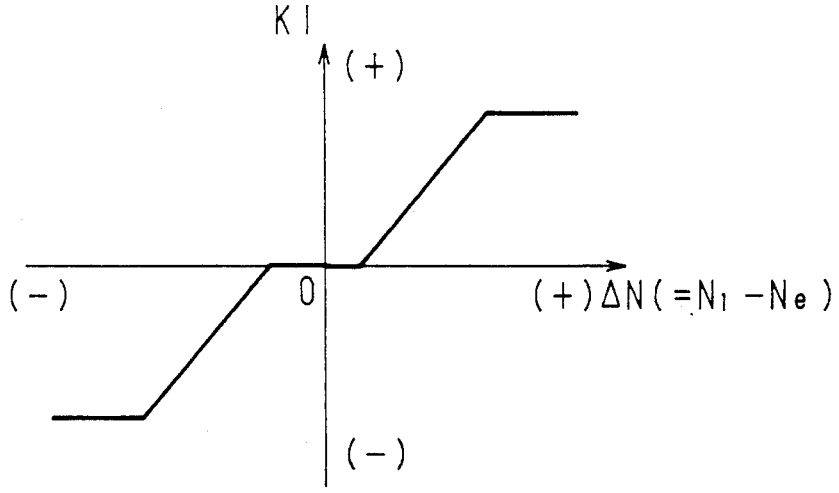
FIG. 4 is a view to explain a $\Delta N$ map.

In Step S6, the deviation $\Delta N$ ($\Delta N = N_t - N_e$) between the target revolutions $N_t$ which was calculated in Step S3 and the latest actual number of revolutions $N_e$ which was calculated in Step S2 is calculated, and control gain KI which is the air volume correction value corresponding to the deviation $\Delta N$ is obtained with reference to the $\Delta N$ map shown in FIG. 4. In Step S7, the control gain KI is added to the latest revolution feedback correction volume $Q_{NFB}$ which was obtained a predetermined period of time (100 ms, for example) before so as to update $Q_{NFB}$.

In Step S8, the basic air volume $Q_{BASE}$ which was calculated in Step S4 is added to the revolution feedback correction volume $Q_{NFB}$ which was calculated in Step S7 or in Step S12, which will be described later, so as to operate the idle revolution control air volume $Q_{ISC}$.

Figure 5:
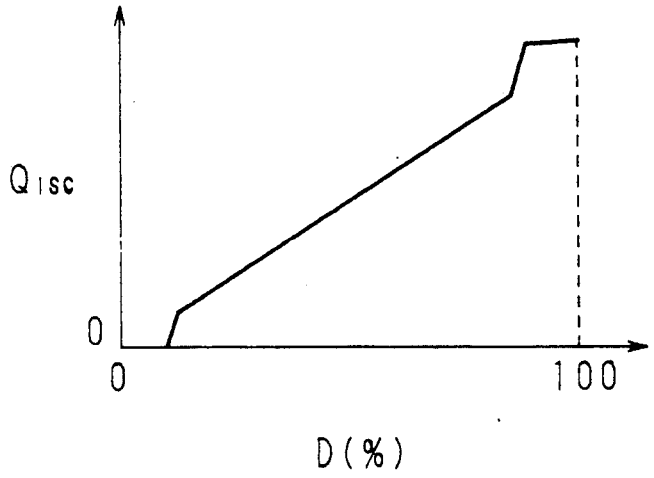
FIG. 5 is a view to designate the relation of the idling revolution control air volume and a duty ratio.
Figure 6:
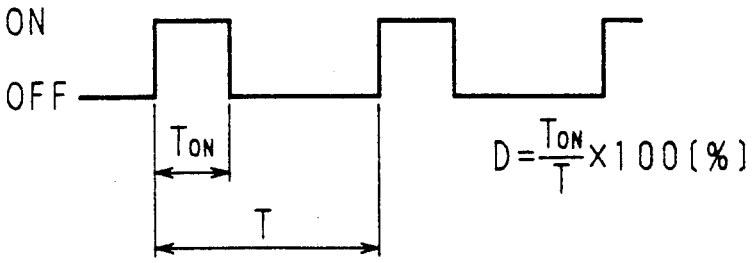
FIG. 6 is a view to explain the duty ratio.

In Step S9, correspondingly to this idle revolution control air volume $Q_{ISC}$ which was calculated before, the duty ratio D of the driving signal to be inputted to the air control valve 11 is operated with reference to the $Q_{ISC}$ map shown in FIG. 5. Assuming that the cycle of the driving signal is T and the ON time during one cycle is $T_{ON}$ as shown in FIG. 6, the duty ratio D is operated according to the formula $$\frac{T_{ON}}{T} \times 100[\%].$$

In Step S10, according to this duty ratio D, the air control valve 11 is driven and the operation described above begins again.

On the other hand, where the engine was decided to be in the non-idling state in Step S1, e.g., the idle switch 9 was OFF or the vehicle speed sensor 17 was generating a pulse signal, the operation proceeds to Step S11. In Step S11, it is decided whether the engine 1 was in the idling state the last time and whether it is in the non-idling state this time, e.g., the idling state of the engine has shifted to the non-idling state. In Step S1, where the engine 1 was decided to be in the idling state, for example, a flag showing "1" was hung, and where the engine 1 was decided to be in the non-idling state, a flag showing "0" was hung, and then, in the decision in this Step S11, the flag which was hung in Step S1 is to be compared with a flag which is hung at present. When the decision of the non-idling state is continued, the operation proceeds to Step S13, and where it is decided that the idling state has shifted to the non-idling state, the operation proceeds to Step S12, in which the increasing air volume $Q_{UP}$ (corresponding to 100 rpm, for example) is added to the latest revolution feedback correction volume $Q_{NFB}$ which was calculated in Step S7 so as to update $Q_{NFB}$, and the operation proceeds to Step S13.

In Step S13, the idle revolution control air volume $Q_{ISC}$ is set to be the air volume $Q_{OPEN}$ which was set in advance when opening of the air control valve was controlled. Then, the operation proceeds to Step S9, in which the same processing as the above is performed.

Incidentally, after the processing in Step S10 is finished, the operation returns to Step S1 to repeat the operation as described above.

In the present embodiment, where the idling state of the engine has shifted to the non-idling state, the increasing air volume $Q_{UP}$ is added to the revolution feedback correction volume $Q_{NFB}$, and then total is to be used when the non-idling state is shifted to the idling state again. Assuming that the current consumer, which was irrespective of the current consumer switch 15 but affected the load of the engine, was injected into the engine of the non-idling state and is unchanged when the non-idling state is shifted to the idling state, opening of the air control valve 11 is controlled to increase correspondingly to the increasing air volume $Q_{UP}$. As a result, the air volume corresponding to the above current consumer is supplied when the non-idling state is shifted to the idling state again, and thus, redundant reduction of revolutions caused by an air shortage in the engine can be avoided.

Hereinbelow, the other embodiment of the present invention will be described.

In the above first embodiment, in order to avoid reduction of revolutions of the engine, when the state of the engine is shifted to the non-idling state, the revolution feedback correction volume corresponding to 100 rpm, for example, is increased.

As mentioned above, by controlling opening of the air control valve, the air supply volume to the engine is controlled, by which the fuel supply volume to the engine is decided. Accordingly, revolutions of the engine can be controlled.

In the first embodiment, however, as the cycle from/to the idling state to/from the non-idling state is repeated in a short time, the increasing air volume of revolution feedback correction volume which is increased where the state of the engine is shifted to the non-idling state is added repeatedly.

As a result, the revolution feedback correction volume becomes too large, and when the non-idling state is shifted to the idling state, the actual revolutions becomes so large in comparison to the target revolutions that it can not smoothly be converged with the target revolutions with adequate responsiveness. Then, there are problems that the driver is discomforted to drive and that he or she must suddenly start to move the vehicle when traveling.

The second embodiment of the present invention is directed to solve the foregoing problems.

Figure 2:
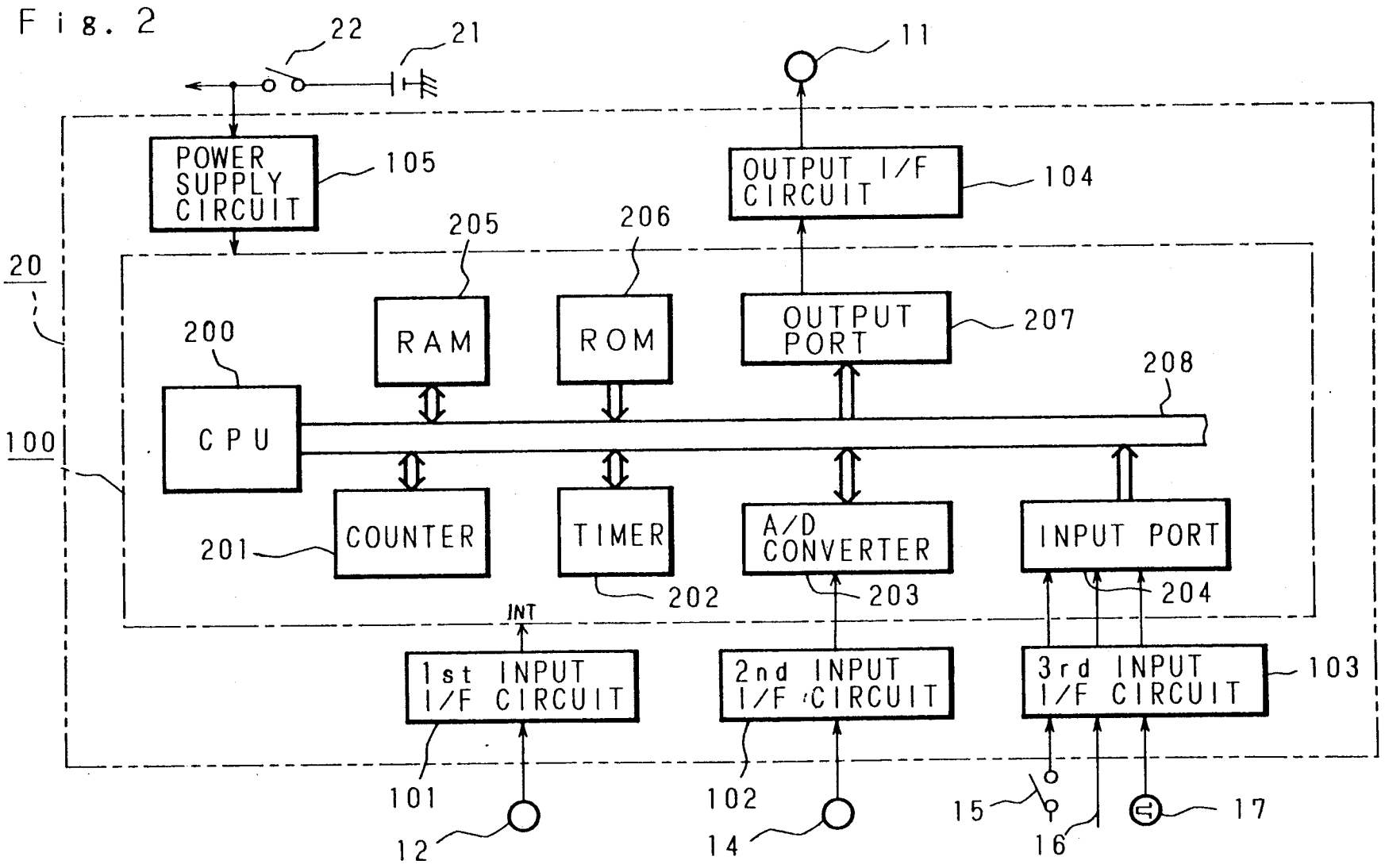
FIG. 2 is a block diagram to illustrate construction of an electronic air volume control apparatus and the like, FIG. 3 is a flow chart to illustrate operation of one embodiment of the present invention.

In this second embodiment of the present invention, construction of those hardware elements numbered identically with the first embodiment of FIGS. 1 and 2 perform the same or similar functions an explanation thereof will be omitted here.

Figure 7:
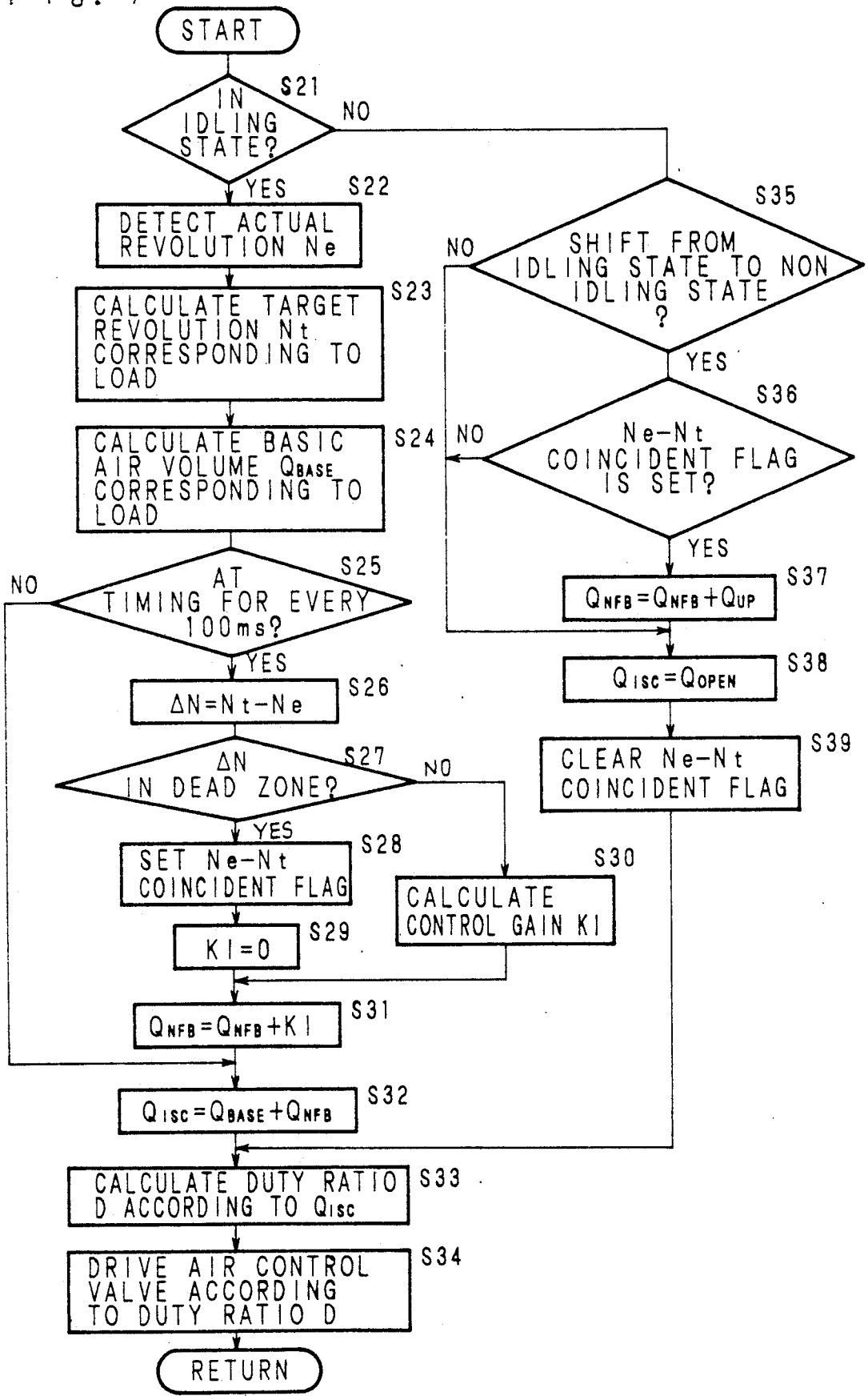
FIG. 7 is a flow chart to illustrate operation of a second embodiment of the present invention.

Hereinbelow, the operation of the second embodiment will be described with reference mainly to FIG. 7.

First in Step S21, it is decided whether the idle switch 9 is ON and the vehicle speed sensor 17 is not generating a pulse signal, which are the conditions that the vehicle is being stopped, e.g., the vehicle is in the idling state. When the idling state is decided, the operation proceeds to Step S22, in which the actual revolutions $N_e$ of the engine 1 is calculated according to the revolving cycle of the engine 1 which was calculated according to an interruption routine (not shown). Then in Step S23, the target revolutions $N_t$ corresponding to the load of the engine 1 is calculated. This target revolutions $N_t$ is operated according to the cooling water temperature data WT which was obtained by the cooling water temperature sensor 1, or according to whether the tor-con signal inputted from the signal conductor 16 is within either a neutral range or a drive range, or as the signal outputted from the current consumer switch 15 is either an ON signal or an OFF signal, for example. In Step S24, as in the same way as Step S23, according to the cooling water temperature data WT, the tor-con signal, the current consumer signal, and the like, the basic air volume $Q_{BASE}$ corresponding to the load of the engine is operated. In Step S25, it is decided whether there is a timing at a predetermined period of time (100 ms, for example). If there is no timing, the operation proceeds to Step S32. If there is a timing, the operation proceeds to Step S26.

In Step S26, there is the calculated deviation $\Delta N$ between the target revolutions $N_t$ which was calculated at Step S23 and the latest actual revolutions $N_e$ which was calculated in Step S22. Then in Step S27, it is decided where the calculated deviation $\Delta N$ is in a dead zone, e.g., the formula $-\Delta N_1 \leqq \Delta N \leqq \Delta N_1$ is established. When the difference calculated is in the dead zone, which means that the actual revolutions $N_e$ is substantially coincident with the target revolutions $N_t$, in Step S28 a flag showing that $N_e$ is coincident with $N_t$ is set, and further in Step S29 the control gain KI is set to be 0, and then, the operation proceeds to Step S31. On the other hand, where the difference is not in the dead zone, which means that $N_e$ is substantially not coincident with $N_t$, the operation proceeds to Step S30, in which the control gain KI not showing 0 is calculated with reference to a $\Delta N$ map shown in FIG. 4. Then, the operation proceeds to Step S31: In Step S31, the control gain KI is added to the latest revolutions feedback correction volume $Q_{NFB}$ in order to update $Q_{NFB}$. In Step S32, the basic air volume $Q_{BASE}$ which was calculated in Step S24 is added to the revolution feedback correction volume $Q_{NFB}$ which was calculated in Step S31 or S37 in order to operate the idle revolution control air volume $Q_{ISC}$.

In Step S33, according to this idle revolution control air volume $Q_{ISC}$, the duty ratio D of the driving signal to be inputted to the air control valve 11 is operated with reference to a $Q_{ISC}$ map shown in FIG. 5. Assuming that the cycle of the driving signal is T and the ON time during one cycle is $T_{ON}$ as shown in FIG. 6, the duty ratio D is obtained by the formula $$\frac{T_{ON}}{T} \times 100[\%].$$

In Step S34, the air control valve 11 is driven according to the duty ratio D, and the operation begins again.

On the other hand, in Step S21 it was decided that the state of the engine is in the non-idling state, e.g., the idle switch 9 was OFF or the vehicle speed sensor 17 was generating a pulse signal, and the operation proceeds to Step S35.

In Step S35, it is decided whether the engine 1 was in the idling state the last time and whether it is in the non-idling state currently, e.g., whether the idling state has shifted to the non-idling state or not. When this is decided, and where the idling state was decided in Step S21, a flag showing "1" was hung, and where the non-idling state was decided, a flag showing "0" was hung, for example. Then, in this decision in Step S35 the present state is decided by comparing the flag which was hung previously with the flag which is hung at present. When and it is decided that the idling state has just shifted to the non-idling state, the operation proceeds to Step S36 to decide whether the flag showing that $N_e$ is coincident with $N_t$ is being set. When the flag is being set, the operation proceeds to Step S37, in which the increasing air volume $Q_{UP}$ (corresponding to 100 rpm, for example) is added to the latest revolution feedback correction volume $Q_{NFB}$ which was calculated in Step S31 so as to update the $Q_{NFB}$, and the operation proceeds to Step S38.

Where the decision of the non-idling state is continued in Step S35 or it is decided that the flag showing that $N_e$ is coincident with $N_t$ is not being set, the operation also proceeds to Step S38.

In Step S38, the idle revolution control air volume $Q_{ISC}$ is set to be the air volume $Q_{OPEN}$ which was set in advance when the opening of the control valve is controlled, and the operation proceeds to Step S39. In Step S39. the flag showing that $N_e$ is coincident with $N_t$ is cleared, and the operation proceeds to Step S33 to do the same processing as described above.

After the processing is finished in Step S34, the operation returns to Step S21 to repeat the operation as described above.

As described above, according to the first embodiment of the present invention, when the idling state of the engine has shifted to the non-idling state, the revolution feedback correction volume is increased and modified to eliminate the deviation between the actual revolutions and the target revolutions, and when the non-idling state has shifted to the idling state again, the increased and modified correction volume is adapted to be used for controlling of the idle revolutions. Hence, when the state of the engine is shifted to the idling state again, redundant reduction of the actual revolutions can be avoided and the driver of this vehicle can comfortably and confidently drive.

Furthermore, according to the second embodiment of the present invention, when the idling state has shifted to the non-idling state, where the actual revolutions is coincident with the target revolutions, the revolution feedback correction volume is increased and modified to eliminate the difference between the actual revolutions and the target revolutions. When the non-idling state is shifted to the idling state again, the increased and modified correction volume is adapted to be used for the idle revolution feedback control. Hence, when the state of the engine is shifted to the idling state again, redundant increase of the actual revolutions can be avoided and the actual revolutions can smoothly be converged with the target revolutions. Accordingly the driver can drive this vehicle comfortably and confidently and he or she is not liable to suddenly start to move the vehicle.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalence of such metes and bounds thereof are therefore intended to be embraced by the claims.

What is claimed is:

1. An engine revolution control apparatus for a vehicle which controls revolutions of an engine when the engine is in an idling state by using an air control valve located in a by-pass conduit for by-passing a throttle valve, said apparatus comprising:

revolution detecting means for detecting revolutions of said engine;

first decision means for deciding whether said engine is in one of the idling state and a non-idling state;

first correction control volume updating means for sequentially calculating and updating at a predetermined timing, when said first decision means decides that said engine is in the idling state, a correction control volume to correct a basic control volume related to a volume of airflow through said by-pass conduit so that no deviation occurs between said revolutions detected by said revolution detecting means and target revolutions thereof;

second decision means for deciding, when said first decision means decides that said engine is in the non-idling state, whether a state of said engine has just shifted from the idling state to the non-idling state;

second correction control volume updating means for adding, when said first decision means decides that the engine is in the non-idling state and said second decision means decides that the engine has just shifted from the idling state to the non-idling state, a predetermined value to the correction control volume updated by said first correction control volume updating means when the engine is in the idling state, so as to update the correction control volume;

opening control means for controlling an opening of said air control valve according to the basic control volume which is corrected by using the correction control volume updated by one of said first and second correction control volume updating means, wherein said revolutions of said engine are prevented from decreasing when said engine changes from said non-idling state to said idling state.

2. An engine revolution control apparatus for a vehicle as set forth in claim 1, further comprising an idle switch, wherein said first decision means decides said engine is in said idling state in response to detection signals outputted from said idle switch which detects a totally closed state of said throttle valve and a vehicle speed sensor which detects a vehicle speed of said vehicle.

3. An engine revolution control apparatus for a vehicle as set forth in claim 1, wherein said target revolutions is set according to a load on said engine.

4. An engine revolution control apparatus for a vehicle as set forth in claim 1, wherein said basic control volume is set according to a load on said engine.

5. An engine revolution control apparatus for a vehicle as set forth in claim 1, wherein said basic control volume is the volume of airflow through said by-pass conduit.

6. An engine revolution control apparatus for a vehicle as set forth in claim 1, wherein said first correction control volume updating mens calculates a latest correction control volume by calculating a control gain corresponding to said deviation and adding said control gain to a correction control volume previously calculated.

7. An engine revolution control apparatus for a vehicle as set forth in claim 5, further comprising third decision means for deciding whether said deviation is within a predetermined range, said first correction control volume updating means, when said third decision means decides that said deviation is within the predetermined range making, said control gain zero.

8. An engine revolution control apparatus for a vehicle which controls revolutions of an engine when the engine is in an idling state by using an air control valve located in a by-pass conduit for by-passing a throttle valve, said apparatus comprising:

revolution detecting means for detecting revolutions of said engine;

first decision means for deciding whether said engine is in one of the idling state and a non-idling state;

first correction control volume updating means for sequentially calculating and updating at a predetermined timing, when said first decision means decides that said engine is in the idling state, a correction control volume to correct a basic control volume related to a volume of airflow through said by-pass conduit so that no deviation occurs between said revolutions detected by said revolution detecting means and target revolutions thereof;

second decision means for deciding, when said first decision means decides that said engine is in the non-idling state, whether a state of said engine has just shifted from the idling state to the non-idling state;

second correction control volume updating means for adding, when said first decision means decides that the engine is in the non-idling state and said second decision means decides that the engine has just shifted from the idling state to the non-idling state, a predetermined value to the correction control volume updated by said first correction control volume updating means when the engine is in the idling state, so as to update the correction control volume;

opening control means for controlling an opening of said air control valve according to the basic control volume which is corrected by using the correction control volume updated by one of said first and second correction control volume updating means, wherein said revolutions of said engine are prevented from decreasing when said engine changes from said non-idling state to said idling state; and third decision means for deciding whether said deviation is within a predetermined range, said second correction control volume updating means adding, when said third decision means decides that said deviation is within the predetermined range, a predetermined value to the correction control volume updated in the idling state of the engine so as to update the correction control volume.

* * * * *